US006390099B1

(12) United States Patent
Dombek

(10) Patent No.: US 6,390,099 B1
(45) Date of Patent: May 21, 2002

(54) APPARATUS FOR CONVOLUTING STRIPS AROUND GROUPS OF COAXIAL ROD-SHAPED ARTICLES

(75) Inventor: Manfred Dombek, Dassendorf (DE)

(73) Assignee: Hauni Maschinenabau AG, Hamburg (DE)

( * ) Notice: Subject to any disclaimer, the term of this patent is extended or adjusted under 35 U.S.C. 154(b) by 0 days.

(21) Appl. No.: 09/461,182

(22) Filed: Dec. 14, 1999

(30) Foreign Application Priority Data

Dec. 14, 1998 (DE) ..... 198 57 576

(51) Int. Cl.[7] ..... A24C 5/10; A24C 1/30; A24C 1/28; A24C 1/26

(52) U.S. Cl. ..... 131/27.1; 131/32; 131/36; 131/55; 131/58

(58) Field of Search ..... 131/27.1, 32, 36, 131/38, 58, 56, 55, 77, 87

(56) References Cited

U.S. PATENT DOCUMENTS

| | | | | |
|---|---|---|---|---|
| 3,064,658 A | * | 11/1962 | Verbakel | 131/29 |
| 4,191,198 A | * | 3/1980 | Chopko et al. | 131/76 |
| 4,193,410 A | * | 3/1980 | Williams et al. | 131/170 |
| 4,445,519 A | * | 5/1984 | Hinz et al. | 131/94 |
| 4,643,203 A | * | 2/1987 | Labbe | 131/94 |
| 4,644,961 A | * | 2/1987 | Horie et al. | 131/94 |
| 4,716,910 A | * | 1/1988 | Gherardi | 131/94 |
| 5,024,242 A | * | 6/1991 | Garthaffner et al. | 131/94 |
| 5,135,008 A | | 8/1992 | Oesterling et al. | |
| 5,577,518 A | * | 11/1996 | Draghetti et al. | 131/32 |
| 5,628,331 A | * | 5/1997 | Mengoli et al. | 131/67 |

FOREIGN PATENT DOCUMENTS

| | | |
|---|---|---|
| DE | 659 064 | 3/1938 |
| DE | 960 347 | 3/1957 |
| DE | 37 02 915 C2 | 8/1988 |
| GB | 1046489 | 10/1966 |

* cited by examiner

*Primary Examiner*—Jose Fortuna
*Assistant Examiner*—Carlos Lopez
(74) *Attorney, Agent, or Firm*—Venable; Robert Kinberg

(57) ABSTRACT

An apparatus, such as a filter tipping machine, wherein groups of coaxial rod-shaped articles are connected to each other end-to-end by adhesive-coated uniting strips or bands, employs two endless conveyor belts having parallel stretches defining an elongated rolling channel and moving in the same direction but at different speeds. A first rotary drum-shaped conveyor is employed to deliver successive groups, each of which can carry a uniting band, sideways into the inlet of the channel wherein the groups are caused to roll and the uniting bands are convoluted around them. A second rotary drum-shaped conveyor receives successive groups of interconnected rod-shaped articles from the outlet of the rolling channel and delivers them to a processing station, such as a severing or packing station, or to a magazine. One of the endless conveyor belts is trained over the drum-shaped conveyors.

30 Claims, 4 Drawing Sheets

APPARATUS FOR CONVOLUTING STRIPS AROUND GROUPS OF COAXIAL ROD-SHAPED ARTICLES

CROSS-REFERENCE TO RELATED CASES

This application claims the priority of German patent application Serial No. 198 57 576.9 filed Dec. 14, 1998. The disclosure of the above-referenced German patent application, as well as that of each U.S. and foreign patent and patent application mentioned in the specification of the present application, is incorporated herein by reference.

BACKGROUND OF THE INVENTION

The invention relates to improvements in apparatus for making composite rod-shaped commodities, such as filter cigarettes, cigars, cigarillos and the like. More particularly, the invention relates to improvements in apparatus wherein successive groups of coaxial rod-shaped articles are connected to each other, end-to-end, by flexible bands or strips which are convoluted around abutting end portions of coaxial articles. As a rule, or at least in many instances, one side of each strip or band (hereinafter called uniting band) is coated with a suitable adhesive so that the convoluted uniting band adheres to and forms a tubular wrapper or envelope around the abutting end portions of the thus joined or assembled composite rod-shaped assemblies.

It is well known to make filter cigarettes in a so-called tipping machine wherein rod-shaped filter mouthpieces of double unit length are placed between pairs of coaxial plain cigarettes of unit length and an adhesive-coated uniting band is convoluted around each mouthpiece of double unit length as well as around the adjacent (inner) end portions of the respective plain cigarettes of unit length. The resulting filter cigarettes of double unit length are severed midway across the tubular wrappers (convoluted uniting bands) to yield pairs of filter cigarettes of unit length. One filter cigarette of each pair is inverted end-for-end and is placed between the non-inverted filter cigarettes to form therewith a row of parallel filter cigarettes which are conveyed sideways to a testing station and thereafter to storage or to a packing machine. Reference may be had to commonly owned U.S. Pat. No. 5,135,008 granted Aug. 4, 1992 to Erwin Oesterling et al. for "METHOD OF AND APPARATUS FOR MAKING FILTER CIGARETTES".

As a rule, the adhesive-coated uniting bands are convoluted around two or more coaxial rod-shaped articles during sidewise travel of the articles in a so-called rolling channel between two surfaces at least one of which moves relative to the other surface. For example, the rolling channel can be defined by the convex peripheral surface of a rolling drum and the complementary concave surface of a stationary rolling member. The inlet of the rolling channel receives successive groups of coaxial rod-shaped articles, and each such group already carries or can carry and adhesive-coated uniting band. The latter is convoluted around the respective group while the group rolls in the channel due to the selected difference between the speeds of the surfaces which bound the channel. Each group can be caused to turn about its longitudinal axis once or more than once depending, e.g., upon the size of the uniting band and/or upon the length of the interval of time which is required to ensure reliable adherence of the convoluted uniting band to the rod-shaped articles of the respective group and/or reliable adherence of convolutions of the rolled-up uniting band to each other.

Heretofore known apparatus for convoluting uniting bands around groups of two or more coaxial rod-shaped articles can be categorized in dependency upon their design and/or mode of operation. A first category employs a rotary drum-shaped conveyor and a stationary block or belt; the stationary part cooperates with the conveyor to define the aforementioned channel wherein successive groups of rod-shaped articles roll from the inlet to the outlet with attendant rolling of the uniting bands around the abutting end portions of the rod-shaped articles in the respective groups. Apparatus of the just outlined character are disclosed, for example, in German patents Nos. 65 90 64, 96 03 47 and 37 02 915.

German patent No. 65 90 64 discloses a filter tipping machine wherein a first rotary drum is provided with peripheral flutes for delivery of groups of coaxial plain cigarettes and filter rod sections into contact with adhesive-coated uniting bands being delivered by a second rotary drum-shaped conveyor which cooperates with a band to define an arcuate channel wherein the uniting bands are convoluted around the respective groups of coaxial rod-shaped articles.

German patent No. 96 03 47 discloses a filter tipping machine wherein the peripheral surface of a drum-shaped conveyor is provided with flutes for groups of coaxial plain cigarettes and filter rod sections. The peripheral surface turns in a first direction and cooperates with a driven belt to define a rolling channel. The belt is driven in a second direction counter to the first direction and such belt further serves to deliver discrete uniting bands to the inlet of the rolling channel; each such band is caused to adhere to and is convoluted around the oncoming group of coaxial plain cigarettes and one or more filter mouthpieces.

German patent No. 37 02 915 discloses a filter tipping machine wherein groups of coaxial plain cigarettes and filter rod sections are contacted by adhesive-coated uniting bands upstream of the inlet of the rolling channel. The groups and the respective uniting bands are delivered by a rotary drum-shaped conveyor which defines the rolling channel with a stationary block-shaped rolling member. The groups which approach the inlet of the channel are engaged by ribs or analogous protuberances provided on rollers or drums which frictionally engage the groups on the rotating conveyor and are thus entrained in a direction toward the inlet while moving at a speed less than the peripheral speed of the conveyor. This causes the groups to roll around their respective axes during advancement from the inlet toward the outlet of the rolling channel.

The aforedescribed filter tipping machines are merely three examples of presently known apparatus wherein uniting bands are caused to connect groups of coaxial rod-shaped articles by means of convoluted adhesive-coated uniting bands. All such apparatus exhibit the serious drawback that at least one of the surfaces bounding the rolling channel is stationary. This can affect the quality and/or the appearance of the thus obtained assemblies of rod-shaped articles and convoluted uniting bands, especially as a result of abrupt initiation of the rolling step at the inlet of the channel. The force which acts upon the groups entering the channel is quite pronounced, and such force does not diminish as the rolling operation progresses. The filter tipping machine which is disclosed in the aforementioned German patent No. 37 02 915 exhibits the additional drawback that the rolling channel is bounded by two stationary surfaces and the parts which are provided with such stationary surfaces cannot yield at all, i.e., the material of such parts is devoid of any elasticity. This can greatly affect the appearance and/or the integrity of the assemblies of coaxial rod-shaped articles (such as plain cigarettes and filter rod sections) and the convoluted uniting bands, especially if the tipping machine is to be operated at a relatively high speed.

The engagement of successive groups by the aforementioned protuberances or projections in the form of ribs or the like, which engage successive groups while moving at a speed well below that of the rotary drum-shaped conveyor, can also result in defacing of and/or in structural damage to the ultimate products.

A second category of presently known apparatus for convoluting uniting bands around groups of coaxial rod-shaped articles differs from the aforedescribed apparatus in that the rolling channel is defined by two moving surfaces provided on driven endless belts. The belts can yield, at least to a certain extent, to thus reduce the likelihood of damage to the rod-shaped articles and to the uniting bands during advancement toward and through the rolling channel. Reference may be had, for example, to British patent No. 1 046 489. However, to the best of applicants' and his assignee's knowledge and belief, apparatus of the type disclosed in the British patent failed to gain acceptance by the makers of filter tipping and like machines.

More specifically, the British patent proposes to provide a rolling channel between the upper reach or stretch of a lower endless belt conveyor and the lower reach or stretch of an upper belt conveyor. The lower belt conveyor is driven at a speed below that of the upper belt conveyor. A drum is employed to deliver groups of coaxial plain cigarettes and filter rod sections onto the upper reach of the lower belt conveyor ahead of the front end turn of the upper belt conveyor, i.e., ahead of the actual inlet of the rolling channel. The lower belt conveyor delivers successive groups toward and into contact with the lower reach of the upper belt conveyor, i.e., into the inlet of the rolling channel. The upper belt conveyor carries the uniting bands which contact the oncoming groups at the inlet of and are convoluted around such groups during travel in the rolling channel. At the same time, the groups are pushed along the rolling channel by entraining elements which are advanced at a speed higher than that of the lower belt conveyor but below that of the upper belt conveyor. The entraining elements serve to advance the assemblies of groups of coaxial rod-shaped articles and convoluted uniting bands beyond the outlet of the rolling channel, along a stationary guide, and into the receptacles of a rotary drum-shaped take-off conveyor.

One serious drawback of the just described patented apparatus is that the uniting bands come into contact with the respective groups of coaxial rod-shaped articles only at the inlet of the rolling channel. Moreover, the patented apparatus is quite complex because it must be equipped with means for driving the upper belt conveyor at a first speed, with means for driving the lower belt conveyor at a different second speed, and with means for driving the entraining elements at a still different third speed. Still further, the three different speeds must be selected and maintained unchanged with a very high degree of accuracy in order to ensure that each uniting band comes into initial contact with a group of coaxial rod-shaped articles exactly at the inlet of the rolling channel. The numerous driving means, belt conveyors, drums and entraining elements contribute to the bulk, complexity as well as initial and maintenance cost of the patented apparatus. It has been found that the entraining elements are especially likely to affect the quality and/or the appearance and/or other characteristics of the ultimate products in that they subject the groups of coaxial rod-shaped articles to the action of pronounced forces often greatly exceeding those which can be withstood by the commodities being processed in filter tipping and analogous machines. It must be borne in mind that the wrappers of plain cigarettes are made of thin sheet material (cigarette paper) and that the wrappers of filter rod sections as well as the uniting bands are also made of a sheet material whose resistance to tearing is relatively low. The material of the uniting bands is known as tipping paper and is often made of artificial cork or the like.

OBJECTS OF THE INVENTION

An object of the invention is to provide an apparatus which can be used in filter tipping and analogous machines as a superior substitute for presently known apparatus serving to convolute uniting bands around groups of coaxial rod-shaped articles, such as plain cigarettes of unit or multiple unit length and filter rod sections of unit or multiple unit length.

Another object of the invention is to provide a novel and improved system of conveyors for groups of rod-shaped articles and for uniting bands for use in the above outlined apparatus.

A further object of the invention is to provide an apparatus wherein the constituents of assemblies of rod-shaped articles and uniting bands are not subjected to pronounced stresses, even if the apparatus is operated at a speed which is required in modern high-speed filter tipping and analogous machines.

An additional object of the invention is to provide an apparatus which can reliably and predictably deliver rod-shaped articles and uniting bands into the rolling channel and can predictably transport finished products from the outlet of such channel.

Still another object of the instant invention is to provide a novel and improved method of supplying the constituents of filter cigarettes, cigars, cigarillos and analogous rod-shaped smokers' products into and of evacuating finished rod-shaped commodities from a tipping machine.

A further object of the invention is to provide an apparatus wherein certain constituents (such as rotary drum-shaped conveyors) can perform several functions to thus contribute to the compactness, simplicity, lower cost and reliability of the apparatus.

Another object of the invention is to provide an apparatus which can be put to use in existing filter tipping and analogous machines in lieu of conventional apparatus including those described in the aforediscussed U.S., German and British patents.

An additional object of the invention is to provide an apparatus wherein the articles entering into and advancing in the rolling channel need not be contacted and acted upon by any rigid parts which could adversely affect the appearance and/or other desirable characteristics of filter cigarettes or analogous smokers' products.

Another object of the invention is to provide novel and improved drum-shaped and other conveyors for use in the above outlined apparatus.

A further object of the invention is to provide an apparatus which can be put to use in modern high-speed production lines for the making of filter cigarettes, cigars, cigarillos or other filter-tipped rod-shaped smokers' products of the tobacco processing industry.

Still another object of the invention is to provide a novel and improved method of making filter cigarettes, cigars or cigarillos.

SUMMARY OF THE INVENTION

The invention resides in the provision of an apparatus for convoluting flexible strips (such as the aforementioned adhesive-coated uniting bands) around rod-shaped commodities (such as two or more rod-shaped articles of the tobacco processing industry which are to be connected with each other end-to-end by convoluting a strip around the abutting end portions of the articles). The improved apparatus comprises a rolling unit including first and second walls which define an elongated rolling channel having an inlet and an outlet, and means for moving at least one of the wall in a direction from the inlet toward the outlet so that a strip adjacent a commodity which is admitted into the inlet is convoluted around such commodity on its way toward the outlet of the rolling channel (namely while the commodity is caused to move sideways as a result of movement of at least one of the walls relative to the other wall). The apparatus further comprises means for introducing successive commodity-strip assemblies of a series of such assemblies into the inlet; such introducing means includes a rotary drum-shaped feeding conveyor which is arranged to admit successive commodities essentially directly into the inlet of the rolling channel.

As already mentioned above, the commodities can constitute groups of coaxial rod-shaped articles of the tobacco processing industry, and the strips can constitute adhesive-carrying uniting bands each of which adheres to the respective group not later than at the outlet of the rolling channel.

It is presently preferred to design the rolling unit in such a way tha each of the walls constitutes an elongated stretch or reach of an endless (one-piece or composite) flexible conveyor belt.

In accordance with an important and highly advantageous feature of the invention, one of the belts is trained over the rotary drum-shaped feeding conveyor. Such one belt has an end turn which is located at the inlet of the rolling channel and is trained over the feeding conveyor in such a way that the axis of the end turn coincides with the axis of the feeding conveyor. The latter can include a portion which constitutes, or which can be said to constitute, a pulley for the end turn of the one belt. The one belt can receive motion directly from the feeding conveyor.

The improved apparatus further comprises means for removing successive assemblies, with the strips convoluted around the respective rod-shaped commodities, from the outlet of the rolling channel. The removing means can comprise a rotary drum-shaped receiving conveyor which can be a mirror image of the feeding conveyor. The one conveyor belt which receives motion from the feeding conveyor is preferably mounted in such a way that its first end turn is trained over the feeding conveyor and that its second end turn is trained over the receiving conveyor. The axis of the second end turn can coincide with the rotational axis of the receiving conveyor. The arrangement can be such that the receiving conveyor includes a first rotary portion serving to receive successive assemblies from the outlet of the rolling channel, and a second rotary portion coaxial with the first portion and including or constituting a pulley for the second end turn of the one conveyor belt. The first and second portions of the receiving conveyor can be mounted for rotation with and relative to each other about a common axis. The re-receiving conveyor or the removing means can further comprise means for rotating the first portion of the receiving conveyor at a first peripheral speed and for rotating the second portion of the receiving conveyor at a second peripheral speed which is higher than the first peripheral speed. Alternatively, the receiving conveyor or the removing means can comprise means for rotating the first and second portions of the receiving conveyor at identical speeds.

The removing means can be constructed and assembled and mounted in such a way that it can accept successive assemblies at least substantially directly from the outlet of the rolling channel.

If the rolling unit comprises one endless belt, such one belt can be trained over the feeding and receiving conveyors. If the rolling unit comprises two endless conveyor belts, one of these belts can be trained over the feeding and receiving conveyors.

The peripheral surface of the rotary drum-shaped receiving conveyor can be provided with receptacles for discrete assemblies of two or more rod-shaped commodities and strips convoluted around the respective commodities; each such receptacle can comprise an abutment and at least one suction port adjacent the abutment to attract an assembly to the abutment. The abutments of the receptacles can constitute elongated ribs which are at least substantially parallel to the rotational axis of the receiving conveyor.

Analogously, the peripheral surface of the rotary drum-shaped feeding conveyor can be provided with receptacles for successive groups of two or more coaxial rod-shaped commodities each. Each such receptacle can comprise an abutment and at least one suction port adjacent the abutment to attract a rod-shaped commodity to the abutment. The abutment of each receptacle at the peripheral surface of the feeding conveyor is or can be at least substantially parallel to the rotational axis of the feeding conveyor.

The receptacles at the periphery of the feeding conveyor can be equidistant from each other (as seen in the circumferential direction of the feeding conveyor), the same as the receptacles at the periphery of the receiving conveyor. The distances between neighboring receptacles of the feeding conveyor can exceed or can be less than or can at least approximate the distances between neighboring receptacles of the receiving conveyor.

The feeding conveyor can be provided or can cooperate with means for introducing into the inlet of the rolling channel groups of rod-shaped commodities simultaneously with the strips which are convoluted in the rolling channel. To this end, the feeding conveyor can comprise first (e.g., pneumatically operated) receptacles for delivering to the inlet groups of coaxial rod-shaped commodities, and second (e.g., pneumatically operated) receptacles for delivering to the inlet strips, one for each of the groups of coaxial commodities delivered by the first receptacles.

Each wall of the rolling unit is preferably provided with a smooth strip-contacting surface confronting the rolling channel. Thus, if each of these walls constitutes a reach or stretch of an endless conveyor belt, each such conveyor belt has a smooth surface which comes in contact with successive groups of coaxial rod-shaped articles and/or with successive strips in the rolling channel.

The aforementioned moving means can include discrete first and second moving devices one of which can drive one of the belts at a first speed and the other of which can drive the other belt at a second speed different from the first speed.

Still further, the improved apparatus can comprise means for heating at least one of the walls, i.e., for heating at least one of the conveyor belts if each wall forms part of a discrete belt. The means for heating can comprise one or more electrically operated heating devices or one or more hydraulic or pneumatic heat exchangers. For example, the heating device or devices can ensure that the bond between the adhesive-coated side of a strip and the adjacent portions of peripheral surfaces of the rod-shaped constituents of the respective assembly (or between the overlapping convolutions of a strip) exhibits a requisite strength when the convoluted strip reaches the outlet of the rolling channel.

The single endless conveyor belt or one of two such belts can constitute a composite belt, i.e., a belt having two or more neighboring but at least slightly spaced-apart relatively narrow belts which are disposed in parallel planes. Thus, at least one of the walls forming part of the rolling unit can consist of two or more elongated strip-shaped portions extending in a direction from the inlet to the outlet of the rolling channel.

The novel features of the apparatus which are considered as characteristic of the present invention are set forth in particular in the appended claims. The improved apparatus itself, however, both as to its construction and the modes of assembling and operating the same, together with numerous additional important advantageous features and attributes thereof, will be best understood upon perusal of the following detailed description of certain presently preferred specific embodiments with reference to the accompanying drawings.

DESCRIPTION OF PREFERRED EMBODIMENTS

Figure 1:
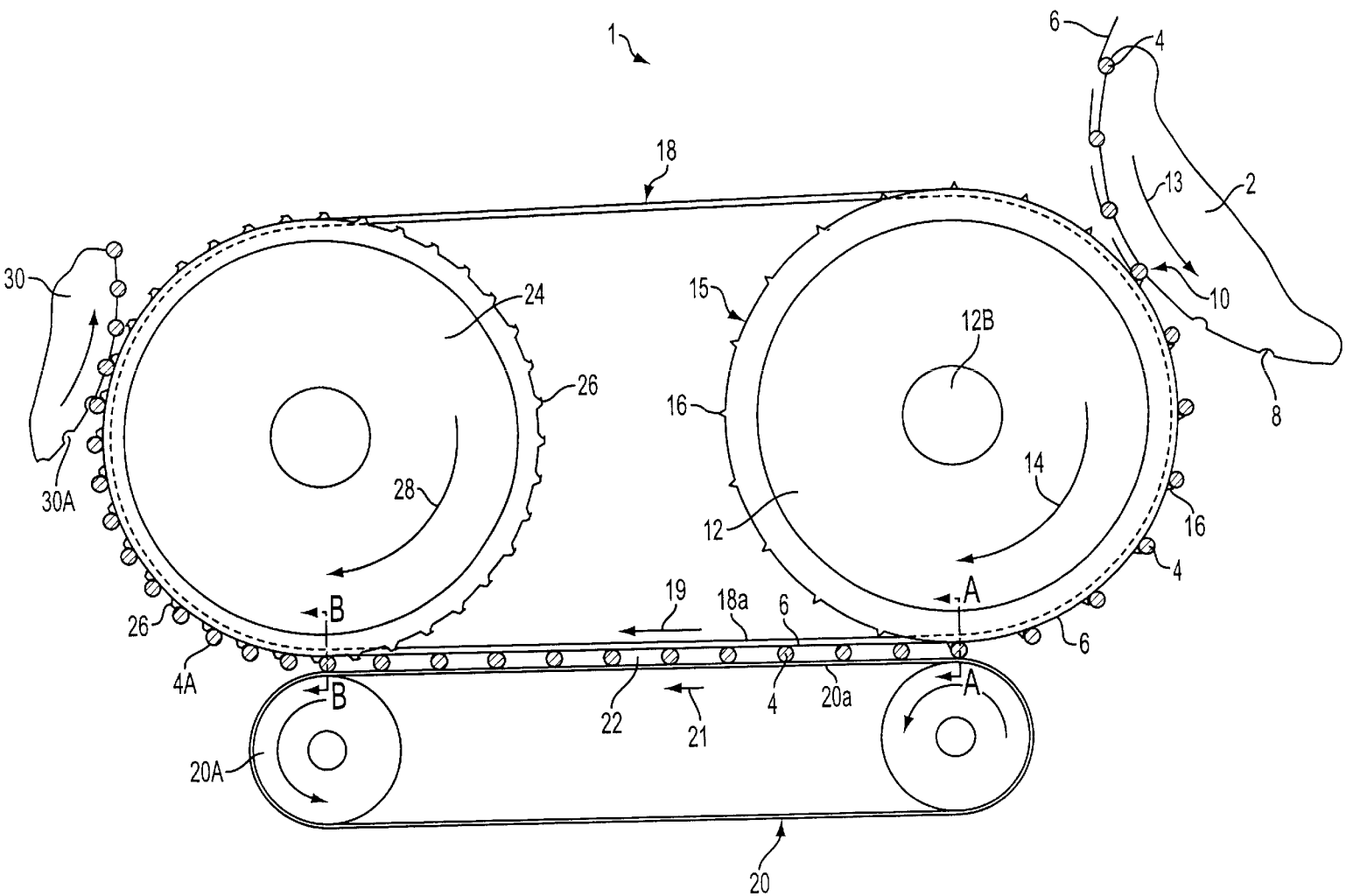
FIG. 1 is a fragmentary side elevational view of an apparatus which can be utilized in a filter tipping machine and embodies one form of the present invention.

FIG. 1 shows an apparatus 1 which forms part of a filter tipping machine and serves to convolute discrete adhesive-coated sheet-like uniting strips or bands 6 around successive groups 4 of coaxial rod-shaped articles including two axially spaced-apart plain cigarettes 4*a*, 4*c* of unit length (see FIG. 2) and a filter mouthpiece 4*b* of double unit length between them. Each uniting band 6 is convoluted around the entire filter mouthpiece 4*b* as well as around the adjacent inner end portions of the two plain cigarettes. The uniting bands consist of a so-called tipping paper (e.g., artificial cork) one side of which is coated with a suitable adhesive.

When the making of an elongated rod-shaped assembly 4A (consisting of two plain cigarettes 4*a*, 4*b*, a filter mouthpiece 4*b* located between and abutting the adjacent end portions of the plain cigarettes, and a tubular envelope (convoluted uniting band 6) which couples the plain cigarettes to the filter mouthpiece) is completed, the assembly (which is a filter cigarette of double unit length) is severed by a suitable cutoff midway across the convoluted uniting band (i.e., midway across the confined filter rod section 4*b* of double unit length) to yield two filter cigarettes of unit length each including one of the plain cigarettes 4*a*, 4*c* and one-half of the filter mouthpiece 4*b* as well as one-half of the convoluted uniting band 6. Such filter cigarettes can be thereupon tested and conveyed to storage or directly to a packing machine. Reference may be had again to the aforementioned commonly owned U.S. Pat. No. 5,135,008 to Oesterling et al.

Figure 2:
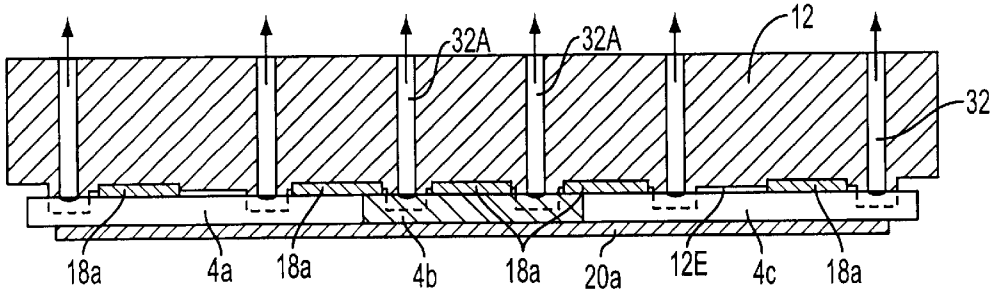
FIG. 2 is an enlarged fragmentary transverse vertical sectional view as seen in the direction of arrows from the line A—A in FIG. 1 and shows the inlet of the rolling channel.
Figure 3:
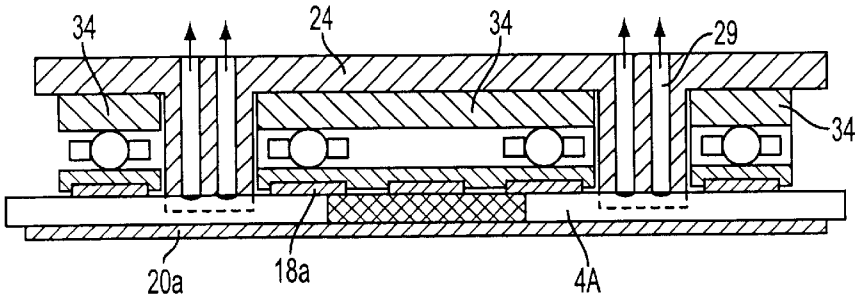
FIG. 3 is a similar enlarged fragmentary transverse vertical sectional view, substantially as seen in the direction of arrows from the line B—B in FIG. 1, and shows the outlet of the rolling channel.

The apparatus of FIGS. 1 to 3 comprises a rolling unit including a first or upper endless flexible conveyor belt 18 and a second or lower endless conveyor belt 20. The conveyor belt 18 includes an elongated substantially horizontal lower reach or stretch 18*a* constituting the upper wall for an elongated rolling channel 22. The lower wall for such channel is defined by an elongated substantially horizontal upper reach or stretch 20*a* of the lower conveyor belt 20.

The means for supplying successive groups 4 into the inlet (right-hand end) of the rolling channel comprises a rotary drum-shaped feeding conveyor 12 which is driven by the shaft 12B (or by any other suitable means) to rotate in a clockwise direction (see the arrow 14). The shaft 12B further constitutes a means for moving the conveyor belt 18 (so that the lower reach 18*a* advances in the direction indicated by arrow 19) because the right-hand end turn of the conveyor belt 18 is trained over and is coaxial with and receives motion from the feeding conveyor 12. The peripheral surface 15 of the feeding conveyor 12 is provided with equidistant receptacles each of which includes an axially parallel protuberance in the form of an elongated rib 16 and one or more suction ports 32 (see FIG. 2) serving to attract a group 4 to the respective rib 16. The manner in which the suction ports 32 are caused or permitted to communicated with a suction generating device (not shown) in certain angular positions of the feeding conveyor 12 is well known in the art of making and transporting cigarettes or other rod-shaped products of the tobacco processing industry.

The receptacles 16, 32 of the conveyor 12 serve to transport groups 4 (and normally also the uniting bands 6) from a transfer station 10 to the inlet (at the line A—A) of the rolling channel 22. The transfer station 10 is defined by the peripheral surface 15 of the conveyor 12 and the peripheral surface of a rotary drum-shaped group supplying conveyor 2 which is driven to rotate in a counterclockwise direction as indicated by the arrow 13. The peripheral surface of the conveyor 2 is provided with eqidistant receptacles in the form of axially parallel flutes 8 each of which delivers to the transfer station 10 a group 4 of three coaxial rod-shaped articles 4*a*, 4*b*, 4*c* and an adhesive-coated uniting band 6 adhering to and extending substantially tangentially from the peripheral surface of the respective filter rod section 4*b* and the adjacent end portions of the respective plain cigarettes 4*a*, 4*c*. The flutes 8 communicate with suction ports (not shown) which attract the groups 4 on their way from a location where the conveyor 2 receives groups 4 to the transfer station 10.

The means for driving the lower conveyor belt 20 in such a way that its upper reach 20*a* advances in the direction of the arrow 21 comprises one of the pulleys for the belt 20, e.g., the left-hand pulley 20A. The speed of the lower reach 18*a* exceeds the speed of the upper reach 20*a*; this causes the groups 4 to roll between the adjacent (preferably smooth) surfaces of the reaches 18*a*, 20*a* on their way from the inlet (at A—A) toward the outlet (at B—B) of the channel 22 which, in turn, causes the uniting bands 6 to become convoluted around the entire peripheral surfaces of the respective filter rod sections 4*b* as well as about the adjacent inner end portions of the respective plain cigarettes 4*a*, 4*c*. The thus obtained rod-shaped assemblies 4A leave the rolling channel 22 at B—B and are taken over by a removing means including a rotary drum-shaped receiving conveyor 24. The latter is or can constitute a mirror image of the conveyor 12 and is driven to rotate in a clockwise direction (see the arrow 28).

The axes of rotation of the conveyors 2, 12 and 24 are parallel to each other and to the axes of the pulleys (including 20A) for the conveyor belt 20. The left-hand end turn of the belt 18 is trained over and is coaxial with the receiving conveyor 24.

The peripheral surface of the conveyor 24 is provided with equidistant receptacles each of which includes a protuberance in the form of an elongated rib 26 which is parallel to the axis of the conveyor 24, and one or more suction ports 29 (see FIG. 3) which attract discrete rod-shaped assemblies 4A to the respective ribs 26 during travel of such assemblies from the outlet of the rolling channel 22 to the transfer station between the conveyor 24 and a rotary drum-shaped take-off conveyor 30. The latter can transport successive assemblies 4A to a severing station (not shown) where the assemblies 4A are halved to yield pairs of filter cigarettes of unit length. Each filter cigarette of unit length contains one of the plain cigarettes 4*a*, 4*c*, one-half of a filter mouthpiece 4*b* and one-half of a convoluted uniting band 6.

Some of the suction ports 32 (e.g., the two centrally located annuli of ports denoted in FIG. 2 by the character 32A) serve to attract the uncoated sides of the uniting bands 6 to the peripheral surface 15 of the conveyor 12 during advancement of the respective groups 4 from the transfer station 10 to the inlet of the rolling channel 22. At such time, the suction ports 32 advancing (in the direction indicated by the arrow 14) ahead of the suction ports 32A attract the respective groups 4 against the trailing sides of the ribs 16 immediately in front of such groups.

The movements of the feeding conveyor 12 and of the conveyor belts 18, 20 are synchronized in such a way that a group 4 reaching the inlet of the rolling channel 22 comes into contact with the underside of the lower reach 18*a* of the belt 18 simultaneously with initial contact with the upper side of the upper reach 20*a* of the belt 20. The forward speed of the lower reach 18*a* (in the direction indicated by the arrow 19) exceeds the forward speed of the upper reach 20*a* in the direction of the arrow 21 but matches the peripheral speed of the feeding conveyor 12. The difference between the forward speeds of the reaches 18*a*, 20*a* causes the groups 4 to roll on their way toward the outlet of the channel 22 and the uniting bands 6 are convoluted around the respective groups 4. The number of rolling movements of groups 4 on their way from the inlet to the outlet of the channel 22 depends upon the difference between the forward speeds of the reaches 18*a* and 20*a*. At least one of these speeds is or can be variable; for example, the pulley 20A for the belt 20 can be driven by a suitable prime mover (such as an electric motor) at any one of a range of different speeds. Zero speed is one of the range of speeds for the belt 20; however, it is preferred to maintain each of the belts 18, 20 in motion when the improved apparatus 1 is in actual use, and the direction (arrow 19) of movement of the lower reach 18*a* is always the same as the direction (arrow 21) of movement of the upper reach 20*a*.

The speed of movement of the belt 18 in the direction of arrow 19 is less than the peripheral speed of the removing conveyor 24 (in the direction of arrow 28). This causes assemblies 4A to roll (at the outlet of the channel 22) relative to the lower reach 18*a* of the belt 18 and to thus move against the immediately preceding ribs 26. Such mode of transferring assemblies 4A from the outlet of the channel 22 is desirable and advantageous because the assemblies advancing in the direction of arrow 28 from the channel 22 to the transfer station between the conveyors 24, 30 are invariably equidistant from each other. This ensures predictable transfer of successive assemblies 4A into successive axially parallel peripheral flutes 30A of the takeoff conveyor 30.

It will be noted that the drum shaped conveyors 12, 24 of the apparatus 1 are driven to rotate clockwise in contrast to the drum-shaped conveyors 2, 30 which are driven to rotate counterclockwise.

FIG. 2 shows that the upper belt 18 is assembled of five narrower endless belts or strips which are located in parallel vertical planes extending at right angles to the plane of FIG. 2. Each of the five illustrated narrower strips of the belt 18 is received in a discrete groove 12E provided therefor in the peripheral surface 15 of the conveyor 12. Such configuration of the peripheral surface 15 ensures that the groups 4 can readily enter the inlet of the channel 22 and that the undersides of those portions of the endless strips of the belt 18 which are located at the six o'clock position of the conveyor 12 (as seen in FIG. 1) are tangential to the peripheral surface 15. Each of the five strips of the belt 18 shown in FIG. 2 is located between two neighboring suction ports 32 and/or 32A. Such suction ports serve to attract successive groups 4 and the respective uniting bands 6. A row of suction ports 32, 32A is located behind each rib 16 at the peripheral surface 15 of the conveyor 12. It is clear that the number of suction ports in each such row can exceed or can be less than six.

As shown in FIG. 3, the rotary drum-shaped receiving conveyor 24 includes a first rotary portion which is provided with the suction ports 29 serving to attract the assemblies 4A to the adjacent ribs 26, and a second portion 34 which constitutes a pulley for the five discrete endless strips of the belt 18. The pulley 34 and the first portion of the conveyor 24 can rotate relative to each other. The pulley need not be driven by a discrete prime mover or the like, i.e., it can be rotated by the belt 18 which, in turn, is driven by the shaft 12B for the conveyor 12. It is preferred to drive the belt 18 at a speed which exceeds the peripheral speed of the first portion of the conveyor 24. This insures that the assemblies 4A at the outlet of the channel 22 are advanced at a speed higher than the peripheral speed of the conveyor 24. In other words, the ribs 26 of the receptacles at the peripheral surface of the conveyor 24 can reduce the speed of successive assemblies 4A arriving at the outlet of the channel 22 to a speed which is determined by the peripheral speed of the first portion of the conveyor 24 and its ribs 26. The difference between the peripheral speeds of the conveyors 12 and 24 is compensated for by increasing the number of ribs 26 as compared with the number of ribs 16. This ensures a reduction of absolute speed but not a reduction of the number of assemblies 4A arriving at the conveyor 30 per unit of time.

Figure 4:
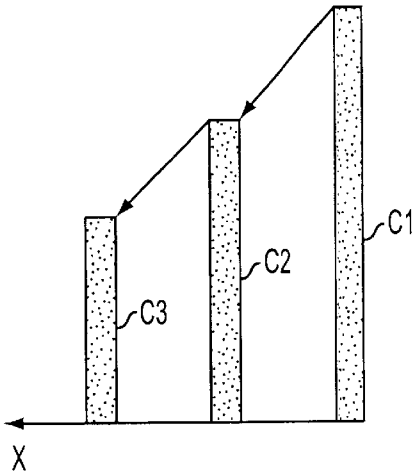
FIG. 4 is a distance-velocity diagram relating to the mode of operation of the apparatus embodying the structure shown in FIGS. 1 to 3.

The diagram of FIG. 4 illustrates the differences between speeds of the groups 4 and assemblies 4A during various stages of their advancement along the path defined by the apparatus embodying the structure shown in FIGS. 1 to 3. The speeds are denoted by the heavy-line upright columns C1, C2 and C3, and the distance covered by the groups 4 and thereafter by the assemblies 4A is measured along the abscissa in the direction of the arrow x. Each of the columns represents the absolute value of the speed in a particular portion of the aforementioned path which extends from the transfer station 10 between the conveyors 2, 12 and the transfer station between the conveyors 24, 30. The column C1 denotes the highest speed at which the groups 4 and the respective uniting bands 6 are advanced from the transfer station 10 to the inlet (at A—A) of the rolling channel 22. The median column C2 denotes the somewhat reduced speed of the groups 4 between the inlet and the outlet (at B—B) of the channel 22. The column C3 denotes the further reduced speed of the assemblies 4A between the outlet of the channel 22 and the transfer station between the conveyors 24, 30.

It is clear that the apparatus of FIGS. 1 to 3 can be modified to assemble single plain cigarettes (4*a* or 4*c*) of unit length with discrete filter rod sections of unit length. Such apparatus can employ relatively short uniting bands each of which is convoluted around the filter rod section and the adjacent end portion of the cigarette.

Figure 5:
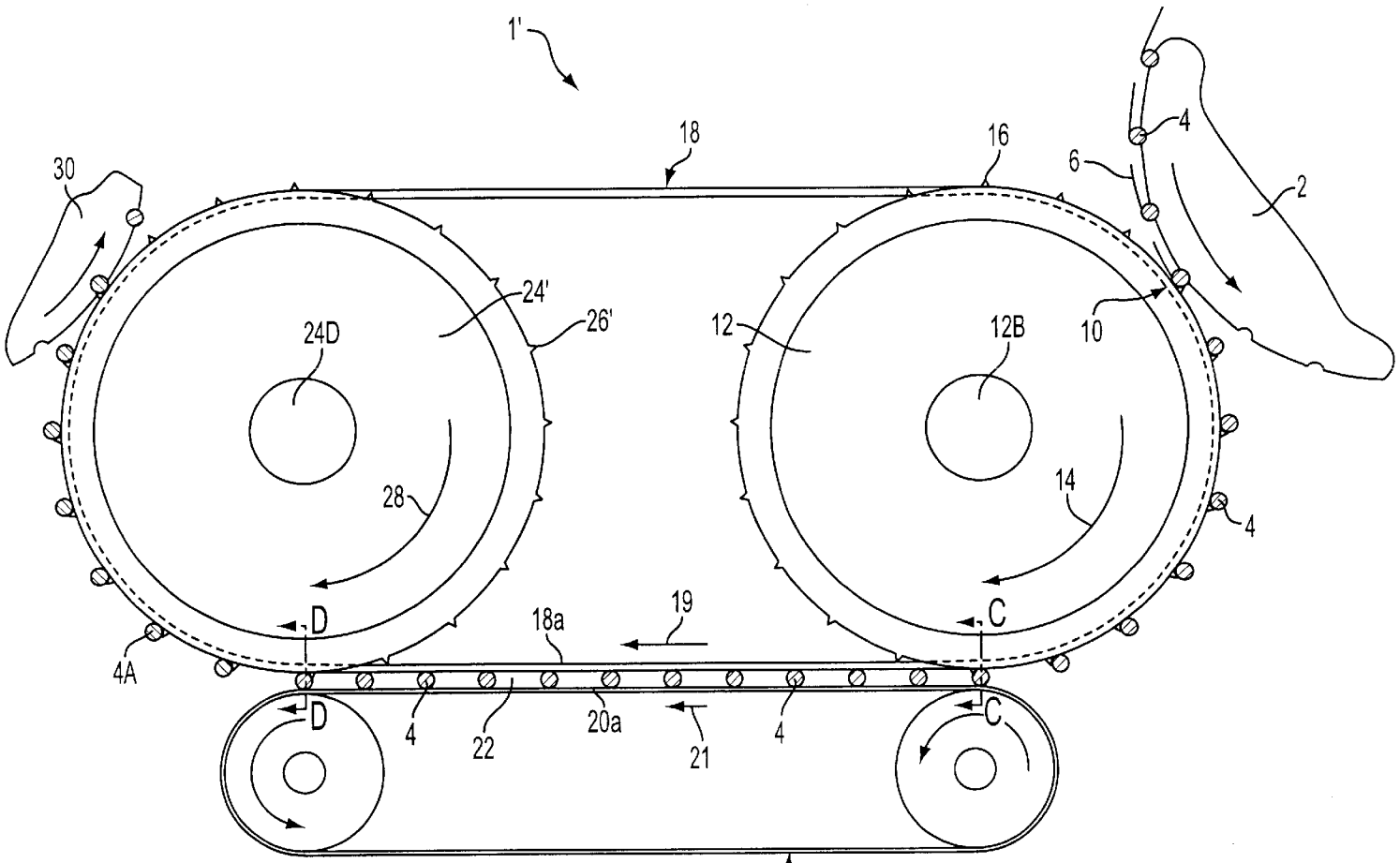
FIG. 5 is a fragmentary side elevational view of an apparatus constituting a modification of the apparatus shown in FIGS. 1 to 3.
Figure 6:
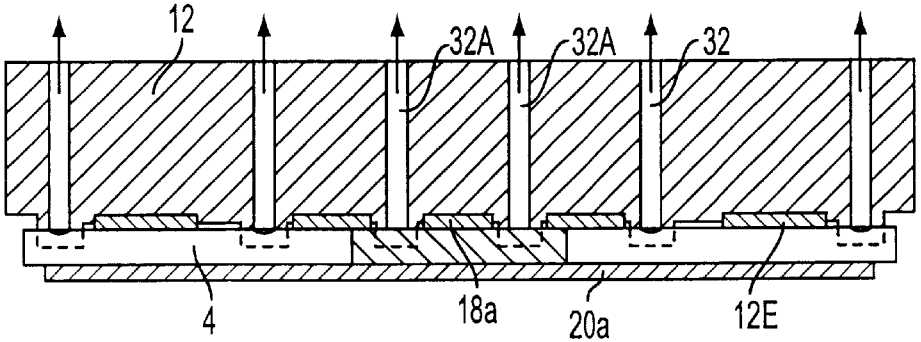
FIG. 6 is enlarged fragmentary transverse vertical sectional view, substantially as seen in the direction of arrows from the line C—C of FIG. 5.
Figure 7:
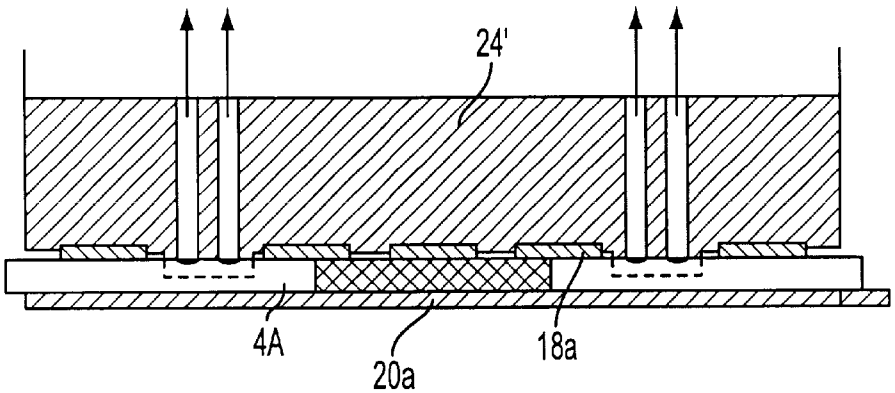
FIG. 7 is a similar fragmentary transverse vertical sectional view substantially as seen in the direction of arrows from the line D—D of FIG. 5.

The apparatus 1' of FIGS. 5, 6 and 7 constitutes a modification of the apparatus 1 of FIGS. 1 to 3. All such parts of the apparatus 1' which are identical with or clearly analogous to those of the apparatus 1 are denoted by the same reference characters. One of the differences between the apparatus 1 and 1' is that the drum-shaped receiving conveyor 24' of FIG. 5 is driven (in the direction of arrow 28) at a speed higher than that of the conveyor belt 18 (in the same direction indicated by the arrow 19). Furthermore, the protuberances or ribs 26' at the periphery of the conveyor 24' are arranged to entrain (rather than precede) the adjacent rod-shaped assemblies 4A. This ensures that the speed of the assemblies 4A (during advancement with the ribs 26' of the conveyor 24') again matches the speed of the groups 4 and uniting bands 6 during travel with the feeding conveyor 12.

Figure 8:
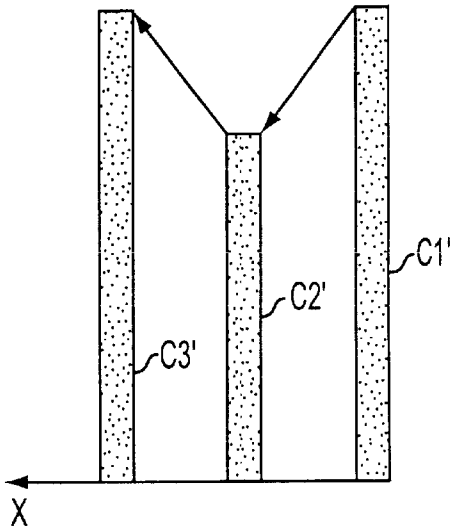
FIG. 8 is a distance-velocity diagram relating to a presently preferred mode of operation of the apparatus which is shown in FIGS. 5 to 7.

The column C1' in the diagram of FIG. 8 indicates the speed of the groups 4 on their way from the transfer station 10 to the inlet (at C—C) of the rolling channel 22 in the apparatus 1'. The column C2' indicates the speed of the groups 4 (i.e., of developing assemblies 4A) between the inlet (at C—C) and the outlet (at D—D) of the channel 22 defined by the two neighboring reaches of the conveyor belts 18, 20 in the apparatus 1', and the column C3' denotes the speed of the assemblies 4A with the conveyor 24' from the outlet of the channel 22 to the transfer station between the conveyors 24', 30.

FIG. 7 shows that the conveyor 24' does not comprise two portions which are rotatable relative to each other, i.e., the pulley 34 of FIG. 3 is omitted and the five strips of the belt 18 receive motion directly from the one-piece conveyor 24'; the latter is driven by a shaft 24D. This shaft 24D drives the conveyor 24', the belt 18 and the conveyor 12 of the apparatus 1', i.e., the shaft 12B for the conveyor 12 of FIGS. 5 and 6 need not be driven by a motor.

An important advantage of the improved apparatus is that it ensures a gentle delivery of rod-shaped groups to and an equally gentle advancement of such groups and uniting bands in the rolling channel 22. Moreover, the timing of delivery of successive groups 4 and uniting bands 6 into the inlet of the rolling channel is highly predictable and remains unchanged for any desired interval of time. Such advantages are achieved in spite of the surprising simplicity of the apparatus. For example, the aforediscussed entraining elements which are necessary in the apparatus of the British patent No. 1 046 489 can be omitted. The absence of such entraining elements contributes significantly to simplicity and reliability of the improved apparatus. Such simplicity and reliability is further enhanced in that the feeding conveyor 12 can serve as a means for driving the belt 18 and the first portion of the receiving conveyor 24 (FIG. 1) or in that the shaft 24D of FIG. 5 can serve as a means for driving the conveyor 24', the belt 18 and the conveyor 12 (FIG. 5). Thus, the conveyor 12 in the apparatus 1 can perform several functions, and the same applies for the conveyor 24' of the apparatus 1'. The apparatus 1' can operate properly without a pulley corresponding to the pulley 34.

An advantage of the feature that the belt 18 is driven at a speed exceeding the speed of the belt 20 is that a group 4 reaching the inlet of the channel 22 is set in motion in proper direction (namely to convolute the band 6 around such group) at the very instant when the group comes into contact with the upper reach 20*a* of the belt 20 at the inlet of the channel 22. In other words, it is possible to determine in advance the start of the convoluting step for each of a short or long series of successive uniting bands 6 arriving at the inlet of the chanel 22. This is important for the quality of the connections which the convoluted uniting bands 6 must establish between the rod-shaped constituents of the respective groups 4.

An advantage of the apparatus 1 (which employs the pulley 34) is that the RPM of the pulley can be selected with a view to transport the assemblies 4A from the outlet of the channel 22 at a speed which matches or approximates the forward speed of the groups 4 in the rolling channel or at a speed which is higher or lower than such forward speed. This contributes to the versatility of the apparatus 1 and to versatility of the filter tipping machine which employs or embodies or cooperates with such apparatus.

As already mentioned hereinbefore, the apparatus 1 and/or 1' can be equipped with suitable means for heating at least one of the belts 18, 20, at least in the region of the rolling channel. For example, the feeding conveyor 12 and/or the puley 20A can constitute a means for heating the belt 18 and/or 20. Heating of the belt 18 and/or 20 is particularly desirable if the nature of the adhesive for one side of each uniting band 6 approaching the inlet of the rolling channel 22 is such that the reliability of the bonds between the uniting bands and the respective groups 4 is enhanced as a result of heating of the adhesive. In other words, the heating step ensures that the adhesive sets not later than on arrival of the respective (convoluted) uniting band 6 at the outlet of the rolling channel 22.

The utilization of a composite belt 18 which consists of several discrete endless bands or strips is desirable and advantageous because this renders it possible to distribute the suction ports 32, 32A and the lengths of sections of composite protuberances or ribs 16 with a view to guarantee predictable advancement of groups 4 and uniting bands 6 from the transfer station 10 to the inlet (at A—A or C—C) of the rolling channel 22.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of filter tipping machines and the like and, therefore, such adaptations should and are intended to be comprehended within the meaning and range of equivalence of the appended claims.

What is claimed is:

1. Apparatus for convoluting flexible strips around rod-shaped commodities, comprising:

a rolling unit including first and second walls defining an elongated rolling channel having an inlet and an outlet, and means for moving at least one of said walls in a direction from said inlet toward said outlet so that a strip adjacent a commodity admitted into said inlet is convoluted around such commodity on its way toward said outlet; and means for introducing successive commodity-strip assemblies of a series of such assemblies into said inlet, including a rotary drum-shaped feeding conveyor arranged to admit successive commodities essentially directly into said inlet, wherein the feeding conveyor has a peripheral surface provided with receptacles, each receptacle including at least one suction port for retaining a respective one of the commodity-strip assemblies in the receptacle.

2. A method of utilizing the apparatus of claim 1, wherein the commodities are groups of coaxial rod-shaped articles of the tobacco processing industry, the method comprising: adhering strips that are adhesive-carrying uniting bands to the respective group of coaxial rod-shaped articles not later than at the outlet of a rolling channel.

3. The apparatus of claim 1, wherein each of said walls constitutes an elongated stretch of an endless flexible conveyor belt forming part of said rolling unit.

4. The apparatus of claim 3, wherein one of said belts is trained over said feeding conveyor.

5. The apparatus of claim 4, wherein said feeding conveyor is rotatable about a predetermined axis and said one belt trained over said feeding conveyor has an end turn coaxial with said feeding conveyor.

6. The apparatus of claim 5, wherein said feeding conveyor comprises a portion constituting a pulley for said end turn of said one belt trained over said feeding conveyor.

7. The apparatus of claim 6, wherein said one belt trained over said feeding conveyor receives motion from said feeding conveyor.

8. The apparatus of claim 1, further comprising means for removing successive assemblies, with the strips convoluted around the respective rod-shaped commodities, from the outlet of said elongated rolling channel.

9. The apparatus of claim 8, wherein said removing means comprises a rotary drum-shaped receiving conveyor.

10. The apparatus of claim 9, wherein each of said walls constitutes an elongated stretch of an endless flexible conveyor belt forming part of said rolling unit, one of said belts including a first end turn trained over said feeding conveyor and a second end turn trained over said receiving conveyor.

11. The apparatus of claim 10, wherein said receiving conveyor is rotatable about a predetermined axis and said second end turn is coaxial with said receiving conveyor.

12. The apparatus of claim 11, wherein said receiving conveyor includes a first rotary portion arranged to receive assemblies from said outlet and a second rotary portion including a pulley, located between said first rotary portion and said endless flexible conveyor belt, for said second end turn of said one belt, said first and second portions of said receiving conveyor being rotatable relative to each other about said predetermined axis.

13. The apparatus of claim 12, wherein said receiving conveyor further comprises means for rotating said first portion at a first peripheral speed and for rotating said second portion at a second peripheral speed higher than said first speed.

14. The apparatus of claim 12, wherein said receiving conveyor further comprises means for rotating said first and second portions at identical speeds.

15. The apparatus of claim 1, further comprising means for removing successive assemblies, with the strips convoluted around the respective rod-shaped commodities, from the outlet of said elongated rolling channel, said removing means including means for accepting successive assemblies at least substantially directly from the outlet of said rolling channel.

16. The apparatus of claim 1, further comprising means for removing successive assemblies, with the strips convoluted around the respective rod-shaped commodities, from the outlet of said elongated rolling channel, said removing means comprising a rotary drum-shaped receiving conveyor and said rolling unit comprising an endless flexible conveyor belt including one of said walls and being trained over said feeding and receiving conveyors.

17. The apparatus of claim 1, further comprising means for removing successive assemblies, with the strips convoluted around the respective commodities, from the outlet of said elongated rolling channel, said removing means comprising a rotary drum-shaped receiving conveyor having a peripheral surface provided with receptacles for discrete assemblies of rod-shaped commodities and strips convoluted around the respective commodities.

18. The apparatus of claim 17, wherein each of said receptacles comprises an elongated rib and at least one suction port adjacent said elongated rib to attract an assembly to the elongated rib.

19. The apparatus of claim 18, wherein said receiving conveyor is rotatable about a predetermined axis and the elongated rib of each of said receptacles is at least substantially parallel to said axis.

20. The apparatus of claim 1, wherein said feeding conveyor has a peripheral surface provided with receptacles for rod-shaped commodities.

21. The apparatus of claim 20, wherein each of said receptacles comprises an elongated rib and at least one suction port adjacent said elongated rib to attract a rod-shaped commodity to the elongated rib.

22. The apparatus of claim 21, wherein said feeding conveyor is rotatable about a predetermined axis and the elongated rib of each of said receptacles is at least substantially parallel to said axis.

23. The apparatus of claim 1, wherein said feeding conveyor has a peripheral surface provided with first equidistant receptacles for rod-shaped commodities and further comprising means for removing successive assemblies, with the strips convoluted around the respective commodities, from the outlet of said elongated rolling channel, said removing means comprising a rotary drum-shaped receiving conveyor having a peripheral surface provided with second equidistant receptacles for discrete assemblies of rod-shaped commodities and strips convoluted around the respective commodities, the distances between said first receptacles being different from the distances between said second receptacles.

24. The apparatus of claim 1, wherein said feeding conveyor has a peripheral surface provided with first equidistant receptacles for rod-shaped commodities and further comprising means for removing successive assemblies, with the strips convoluted around the respective commodities, from the outlet of said elongated rolling channel, said removing means comprising a rotary drum-shaped receiving conveyor having a peripheral surface provided with second equidistant receptacles for discrete assemblies of rod-shaped commodities and strips convoluted around the respective commodities, the distances between said first receptacles at least approximating the distances between said second receptacles.

25. The apparatus of claim 1, wherein said feeding conveyor comprises means for introducing into said inlet rod-shaped commodities simultaneously with the strips which are convoluted in said rolling channel.

26. The apparatus of claim 25, wherein said feeding conveyor comprises first peripheral pneumatically operated receptacles for delivering to said inlet rod-shaped commodities and second peripheral pneumatically operated receptacles for delivering to said inlet strips, one for each of the commodities delivered by said first receptacles.

27. The apparatus of claim 1, wherein each of said walls constitutes an elongated stretch of an endless flexible conveyor belt forming part of said rolling unit, each of said stretches having a smooth surface confronting said elongated rolling channel.

28. The apparatus of claim 1, wherein each of said walls constitutes an elongated stretch of an endless flexible conveyor belt forming part of said rolling unit, one of said belts being trained over said feeding conveyor and said means for moving including means for moving said one belt at a first speed and means for moving the other of said belts at a second speed different from said first speed.

29. The apparatus of claim 1, wherein each of said walls constitutes an elongated stretch of an endless flexible conveyor belt forming part of said rolling unit, and further comprising means for heating at least one of said belts.

30. The apparatus of claim 1, wherein at least one of said walls constitutes an elongated stretch of an endless flexible conveyor belt forming part of said rolling unit, said belt comprising a plurality of spaced-apart discrete endless flexible bands disposed in parallel planes.

* * * * *